United States Patent [19]

Pim

[11] 4,090,388

[45] May 23, 1978

[54] ROLL CHANGING APPARATUS

[75] Inventor: Norman Lester Pim, Salem, Ohio

[73] Assignee: Gulf & Western Manufacturing Company, Southfield, Mich.

[21] Appl. No.: 800,339

[22] Filed: May 25, 1977

[51] Int. Cl.[2] ..... B21B 31/10

[52] U.S. Cl. ..... 72/239

[58] Field of Search ..... 72/239, 238; 294/47, 294/106

[56] References Cited

U.S. PATENT DOCUMENTS

| | | | |
|---|---|---|---|
| 2,067,508 | 1/1937 | Smitmans | 72/238 X |
| 3,593,555 | 7/1971 | Grosko | 72/239 |
| 4,012,825 | 3/1977 | Granitz et al. | 72/239 |

FOREIGN PATENT DOCUMENTS

| | | | |
|---|---|---|---|
| 1,244,693 | 7/1967 | Germany | 72/239 |

*Primary Examiner*—Milton S. Mehr

*Attorney, Agent, or Firm*—Meyer, Tilberry & Body

[57] ABSTRACT

A balance bar device is disclosed for supporting a pair of mill rolls during a roll changing operation. A pair of vertically parallel roll end engaging members are mounted on one end of a beam for pivotal movement about corresponding horizontal axes extending transverse to the beam axis. The members are interconnected by a link so that the parallel relationship is maintained during pivotal movement thereof relative to the beam. The roll end engaging members are provided with bearing surfaces adapted to engage a roll end at diametrically opposed axially spaced apart locations so as to support the roll as a cantilever. By tilting the one end of the beam downwardly the roll end engaging members pivot relative thereto to freely receive the roll end therebetween. By then tilting one end of the balance bar upwardly the bearing surfaces are displaced toward one another to engage the roll neck.

19 Claims, 7 Drawing Figures

FIG. 4
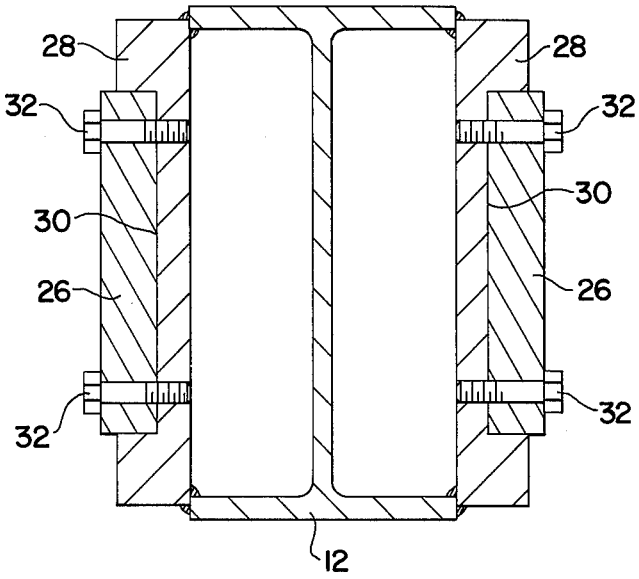
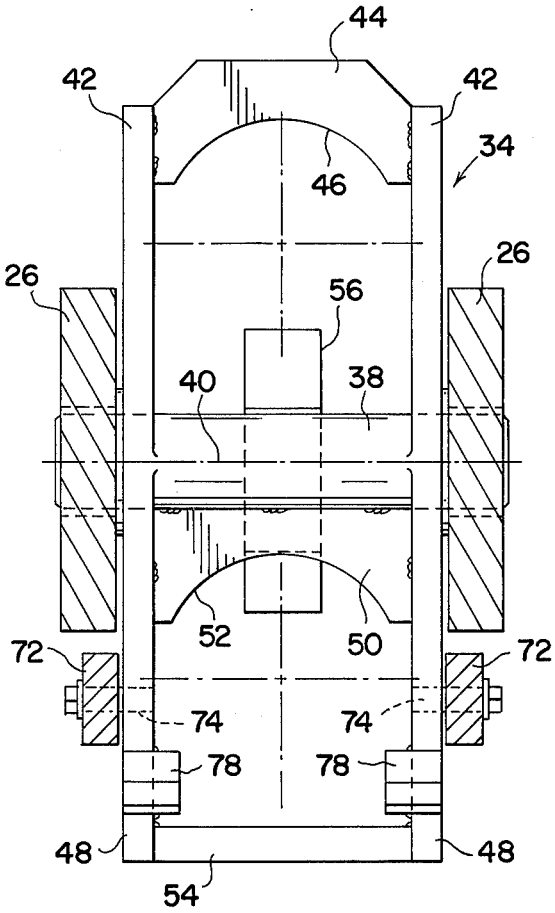
FIG. 5
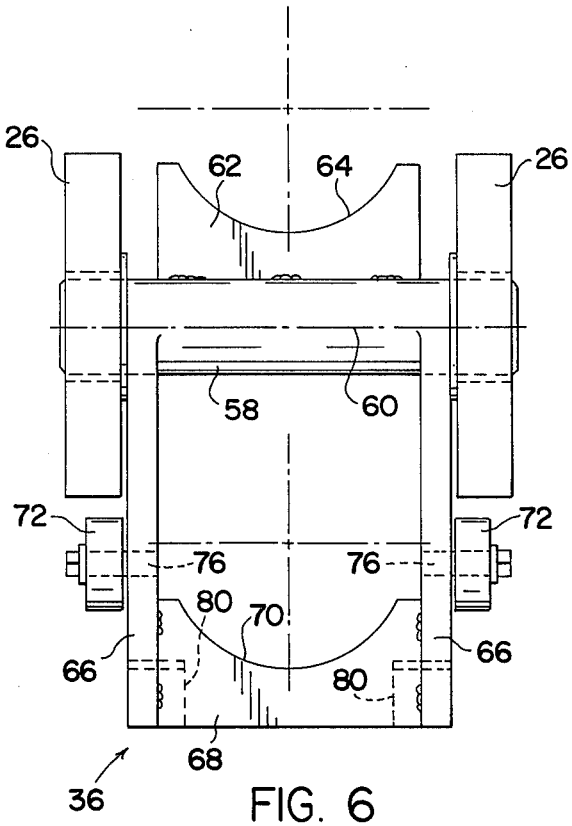
FIG. 6

ROLL CHANGING APPARATUS

This invention relates to the art of roll changing apparatus and, more particularly, to a roll end engaging assembly for use with such apparatus.

Roll insertion and removal relative to a rolling mill is generally achieved either through the use of a balance bar device or a traversing carriage or sled movable along tracks on the floor adjacent the rolling mill. Heretofore, balance bar devices have included an elongated beam having a roll end engaging socket on one end and a counterweight on the other, and the balance bar is conveyed to and from the rolling mill by wire rope slings attached to an overhead traveling crane. Carriage type roll changing equipment of the type that supports and carries the rolls by their ends in a cantilevered manner generally includes one or two roll end engaging sockets which enable the carriage to simultaneously support a pair of vertically adjacent rolls during a roll changing operation.

In conjunction with both balance bar and carriage type roll handling equipment, difficulties are encountered with respect to the roll end engaging sockets and with respect to achieving interengagement of the sockets with roll ends during a roll changing operation. More particularly, to achieve proper support of a mill roll during a roll changing operation, the socket opening receiving the roll end must be accurately machined and dimensioned diametrically to provide minimal clearance between the roll end and the socket opening. Generally, the diameter of the socket opening is only about 1/32 inch larger than that of the roll end, leaving a circumferential clearance of about 1/64 inch when the axes of the socket opening and roll end coincide. Machining of the socket opening is time consuming and expensive, and the minimal clearance makes it imperative to accurately align the socket and roll end for interengagement therebetween in an effort to minimize or avoid damage to the roll end or socket. Accordingly, considerable time is required to achieve a roll changing operation, and the end result is an undesirably long down time for the rolling mill.

The foregoing problems are even more pronounced with balance bar type roll changing equipment in that alignment must be achieved through adjustments of the overhead crane and, once interconnection of the roll end and socket is achieved, the balance bar must be supported to enable adjustment of the wire rope slings to a new position on the beam to properly support the balance bar with the mill roll thereon. Such sling adjustment may involve several attempts in order to achieve proper balanced support of the loaded beam. Additionally, with regard to the most common balance bar type equipment heretofore provided, a balance bar is only capable of supporting and transporting one mill roll at a time. Thus, in a rolling mill having a pair of vertically aligned work rolls, two crane excursions to and from the mill and two roll end engagements are necessary in order to effect a roll change.

In accordance with the present invention, a roll end engaging assembly is provided which overcomes or minimizes the foregoing problems in conjunction with either balance bar or carriage type roll changing apparatus. The invention finds particular utility in conjunction with balance bar type equipment in that the roll end engaging assembly enables a pair of rolls to be engaged and simultaneously supported by the balance bar and, accordingly, the invention is described hereinafter in detail in association with balance bar equipment. However, it will be appreciated that the roll end engaging assembly is equally applicable to carriage type roll changing equipment.

In accordance with the present invention, a roll end engaging assembly for roll changing apparatus is defined by a pair of roll end engaging members having cooperable bearing surfaces for engaging a roll end. More particularly, the bearing surfaces on the two members are positionally interrelated so as to engage diametrically opposed and axially spaced apart upper and lower portions of the roll end to support the roll as a cantilever. Further, the roll end engaging members are supported in a manner which enables maneuvering thereof into position to receive a roll end with the bearing surfaces spaced apart sufficiently to freely receive the roll end therebetween, and the support for the roll end engaging members then enables maneuvering thereof to bring the bearing surfaces into engagement with the roll end. Preferably, the roll end engaging members are each supported for movement about a corresponding horizontal pivot axis transverse to the roll axis, and the members are spaced apart axially with respect to the roll axis. The support member for the roll end engaging members is horizontally tiltable, and tilting movement of the support member in a first direction results in pivotal movement of the roll end engaging members relative to the support member causing the bearing surfaces to be displaced vertically away from one another. Tilting movement of the support member in the opposite direction results in pivotal movement of the roll end engaging members relative to the support member causing the bearing surfaces to be displaced vertically toward one another. In the first disposition of the support member the bearing surfaces are spaced apart to freely receive the roll end therebetween, and in the second disposition the bearing surfaces engage the roll end enabling the roll to be supported as a cantilever.

In the preferred embodiment herein disclosed, the roll end engaging members are pivotally mounted on one end of a balance bar beam having a counterweight at the opposite end thereof. Tilting movement of the beam is achieved by supporting the beam intermediate its opposite ends from an overhead crane and manipulating the beam relative to the overhead support.

By providing for the roll end engaging members to have bearing surfaces vertically displaceable relative to one another in the manner described above, it will be appreciated that the bearing surfaces can be spaced apart to receive the roll end with considerable clearance between the bearing surfaces and roll end, whereby time required to achieve interengagement therebetween is minimized. Furthermore, the clearance provided by such spacing of the bearing surfaces minimizes the likelihood of damage to the roll end and/or bearing surfaces which can occur with a fixed socket having minimum clearance with respect to the roll end. Additionally, the structure of applicant's roll end engaging assembly enables two vertically aligned rolls to be handled at the same time. Accordingly, especially with regard to balance bar type equipment, time loss heretofore encountered by the necessity of two crane excursions to and from the mill and two roll end engaging maneuvers is considerably reduced. Still further, with regard to balance bar equipment, operation time is minimized by eliminating the necessity to support the beam following engagement with a roll end to enable readjustment of the rope slings so that the loaded balance bar is supported in a balanced condition. Thus, personnel time required to achieve a roll changing function is advantageously reduced as is the down time for the rolling mill, thus enabling an increase in production time and a reduction in production and operation costs.

It is accordingly an outstanding object of the present invention to provide an improved roll end engaging assembly for use with roll changing apparatus.

Another object is the provision of a roll end engaging assembly which minimizes the time required to achieve alignment and interengagement of the assembly with a roll end.

Still another object is the provision of a roll end engaging assembly comprised of a pair of roll end engaging members relatively displaceable between first and second positions relative to a roll end and which positions, respectively, provide sufficient clearance to enable the roll end to be freely received between the members and provide for the roll end to be engaged to enable the roll to be supported as a cantilever.

Yet another object is the provision of a roll end engaging assembly which enables simultaneous interengagement with and support of a pair of vertically aligned mill rolls.

A further object is the provision of a roll end engaging assembly which is structurally simple and inexpensive to produce and which enables achieving a roll changing operation in considerably less time than heretofore required, thus decreasing down time for a mill and operation costs thereof while increasing production capabilities of the mill.

Still a further object is the provision of a roll end engaging assembly of the foregoing character in which the roll end engaging members are supported by a balance bar beam to enable manipulation of the balance bar assembly in a manner whereby a roll changing operation is more quickly and efficiently achieved than possible with balance bar equipment heretofore provided.

The foregoing objects, and others, will in part be obvious and in part pointed out more fully hereinafter in conjunction with the written description of a preferred embodiment of the invention illustrated in the accompanying drawings in which:

FIG. 4 is a cross-sectional elevation view taken along line 4—4 in FIG. 1;

FIG. 5 is a sectional elevation view showing one of the roll engaging members and taken along line 5—5 in FIG. 2;

FIG. 6 is an elevation view of the other of the roll end engaging members taken along line 6—6 in FIG. 2; and, FIG. 7 is a sectional elevation view of the roll end engaging assembly showing the assembly in position to receive roll necks therebetween.

Figure 1:
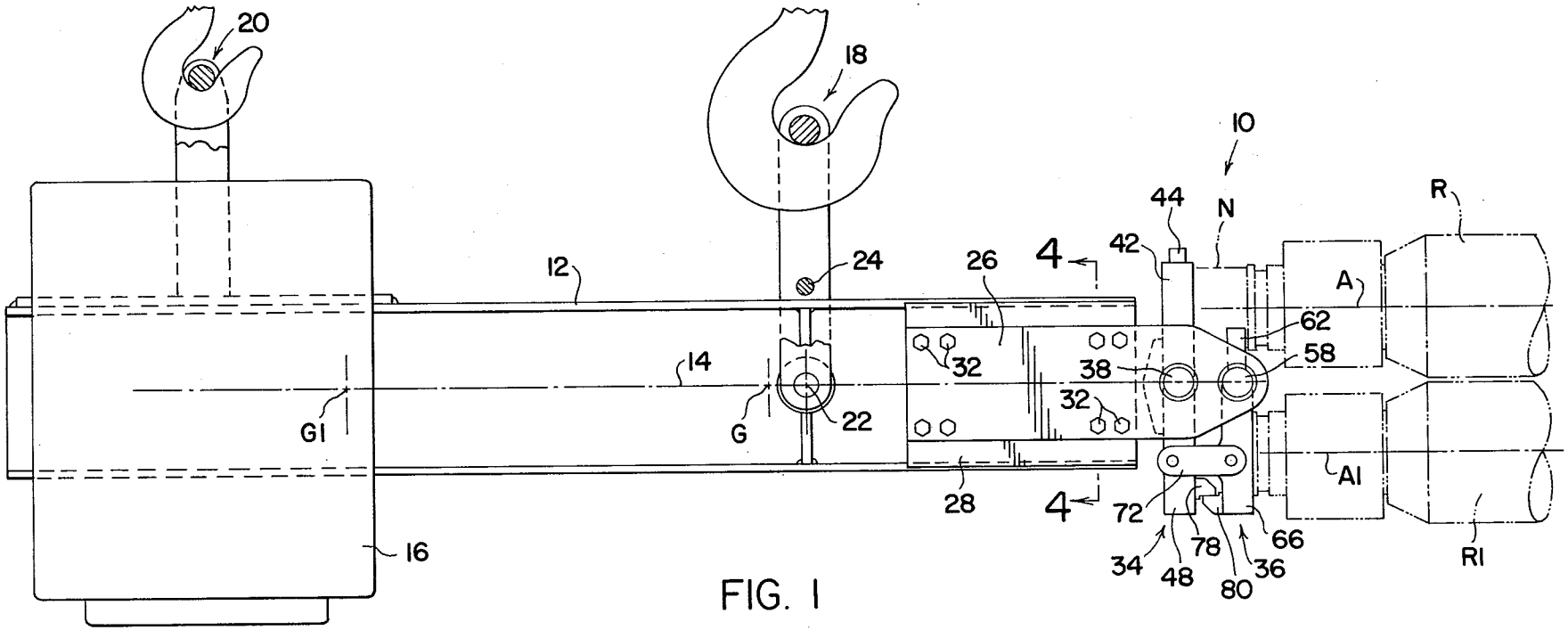
FIG. 1 is a side elevation view of a roll end engaging assembly in accordance with the present invention mounted on a balance bar.

Referring now in greater detail to the drawings wherein the showings are for the purpose of illustrating a preferred embodiment of the invention only and not for the purpose of limiting the invention, a roll end engaging assembly 10 is illustrated in FIGS. 1–4 as being mounted on one end of an elongated I-beam 12 having a longitudinal axis 14. A suitable counterweight 16 is mounted on the opposite end of I-beam 12, and a pair of hook receiving support members 18 and 20 are mounted on the I-beam to facilitate manipulation thereof by an overhead crane during a roll changing operation, as set forth more fully hereinafter. Support 18 is the main support member and is mounted on I-beam 12 for pivotal movement about a horizontal axis 22. A stop pin 24 is provided to maintain the support in a position to conveniently receive a crane hook. Point G on the I-beam designates the center of gravity for the beam assembly when it is loaded with mill rolls to be transferred, and it will be noted that axis 22 is disposed forwardly of point G in the direction toward roll end engaging assembly 10. It will be appreciated, of course, that the center of gravity for the unloaded beam assembly is toward counterweight 16 from point G. The unloaded center of gravity is designated G1 in FIG. 1. and it is to be noted that this point is located forwardly of support member 20 in the direction toward support member 18.

As seen in FIGS. 1–6, roll end engaging assembly 10 includes a pair of spaced apart parallel support arms 26 rigidly attached to the corresponding end of I-beam 12 by means of mounting plates 28 welded to the flanges of the I-beam and having recesses 30 receiving the corresponding support arm 26. Support arms 26 preferably are removably mounted on the I-beam by means of a plurality of nut and bolt assemblies 32. Roll end engaging assembly 10 further includes a first roll end engaging member 34 and a second roll end engaging member 36, which members cooperate with one another as described hereinafter to support a pair of mill rolls R and R1 during a roll changing operation. In the embodiment disclosed, rolls R and R1 have corresponding roll ends N and N1 adapted to be interengaged with the roll end engaging members to achieve the support function.

Figure 2:
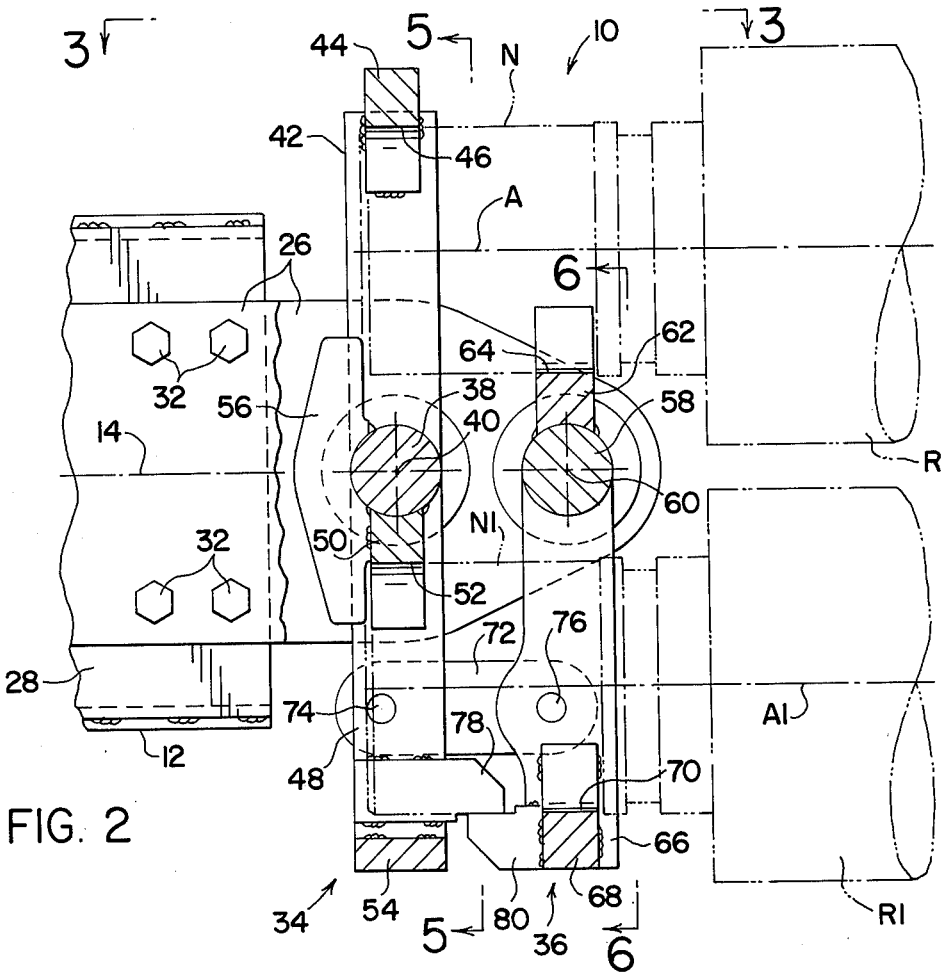
FIG. 2 is an enlarged side elevation sectional view of the assembly.
Figure 3:
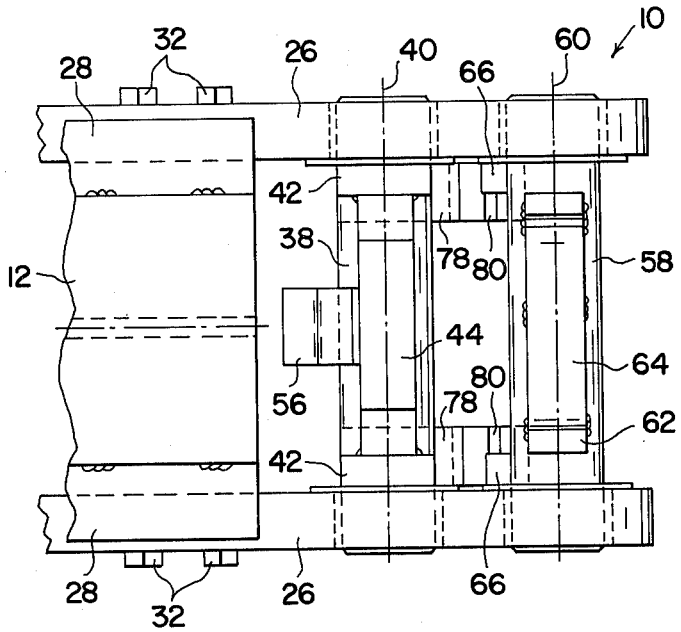
FIG. 3 is a top view of the roll end engaging assembly taken along line 3—3 in FIG. 2.

First roll end engaging member 34, as best seen in FIGS. 2, 3 and 5, includes a pin 38 supported by arms 26 for pivotal movement about a horizontal axis 40 extending transverse to and preferably intersecting beam axis 14 and the axes A and A1 of roll necks N and N1, respectively. Member 34 further includes a pair of upper bar elements 42 axially spaced apart with respect to pin 38 and welded or otherwise attached thereto adjacent the corresponding support arm 26. An upper bearing block 44 extends between bars 42 and is welded or otherwise secured thereto. Bearing block 44 is provided with an arcuate bearing surface 46 facing downwardly and having a radius of curvature corresponding to the radius of roll end N. Member 34 further includes a pair of lower bar elements 48 vertically aligned with bars 42 and welded or otherwise secured to pin 38. A bearing block 50 extends between bars 48 and is welded or otherwise secured thereto and, preferably, to pin 38. Bearing block 50 includes an arcuate bearing surface 52 facing downwardly and having a radius of curvature corresponding to the radius of roll end N1. A cross member 54 extends between the lowermost ends of bars 48 and is welded or otherwise secured thereto to stabilize the lower ends of the bars. A stop member 56 is welded or otherwise secured to pin 38 intermediate the opposite ends thereof and extends vertically above and below pin 38 so as to engage the end faces of roll ends N and N1 during engagement of the latter with assembly 10, as set forth more fully hereinafter.

Second roll end engaging member 36, as best seen in FIGS. 2, 3 and 6, includes a pin 58 supported by arms 26 for pivotal movement about a horizontal axis 60 which is parallel to pin axis 40 and spaced therefrom in the direction outwardly of the corresponding end of beam 12. Preferably, pin axis 60 also intersects beam axis 14 and roll end axes A and A1. Member 36 includes a bearing block 62 which is welded or otherwise secured to pin 58 and extends vertically upwardly therefrom. Bearing block 62 is provided with an arcuate bearing surface 64 facing upwardly and having a radius of curvature corresponding to the radius of roll end N. Member 36 further includes a pair of lower bar elements 66 welded or otherwise secured to pin 58 adjacent support arms 26. A bearing block 68 extends between bars 66 at the lower ends thereof and is welded or otherwise secured thereto. Bearing block 68 includes a bearing surface 70 facing upwardly and having a radius of curvature corresponding to the radius of roll end N1. Each of the roll end engaging members 34 and 36 has a center of gravity below the corresponding pivot axis 40 and 60. Therefore, it will be appreciated that tilting of beam 14 about axis 22 will cause pivotal movement of members 34 and 36 relative to support arms 26, and that members 34 and 36 will remain vertically oriented and parallel to one another during such tilting movement of beam 14. Preferably, such parallel relationship is positively maintained and, in the preferred embodiment, this is achieved by means of a pair of link members 72. Each link 72 has its opposite ends pivotally interconnected one with lower bars 48 of member 34, such as by means of pins 74, and the other with lower bars 66 of member 36, such as by means of pins 76.

When roll end engaging members 34 and 36 are in the positions illustrated in FIGS. 1 and 2, bearing surfaces 46 and 64 are vertically spaced apart a distance corresponding to the diameter of roll neck N, and bearing surfaces 52 and 70 are vertically spaced apart a distance corresponding to the diameter of the roll neck N1. It will be appreciated that pivotal movement of beam 12 about axis 22 in the clockwise direction as seen in FIG. 1 causes relative vertical displacement between members 34 and 36 from the position shown in FIG. 1 to the position shown in FIG. 7. It will be further appreciated that such vertical displacement of members 34 and 36 causes displacement of the cooperable pairs of bearing surfaces vertically away from one another to provide a vertical distance therebetween greater than the diameter of the corresponding roll neck, as will be apparent from FIG. 7. Likewise, it will be appreciated that tilting movement of beam 12 counterclockwise with members 34 and 36 positioned as shown in FIG. 7 causes members 34 and 36 and the cooperable pairs of bearing surfaces to return to the position shown in FIG. 1.

For the purpose set forth hereinafter, members 34 and 36 are preferably provided with interengaging stop fingers 78 and 80, respectively, to limit relative vertical displacement between the members in the direction which displaces the pairs of bearing surfaces toward one another. More particularly, lower bar elements 48 of member 34 are provided with corresponding stop fingers 78 adjacent the lower ends thereof and which fingers project toward member 36. Lower bar elements 66 of member 36 are provided with corresponding stop fingers 80 adjacent the lower ends thereof and which project toward member 34. The ends of fingers 80 underlie the ends of the corresponding fingers 78, whereby the overlapping ends interengage to limit relative vertical displacement between members 34 and 36 as mentioned above. It will be appreciated therefore that tilting movement of beam 12 counterclockwise from the position shown in FIG. 1 results in members 34 and 36 being displaced with the beam and without further displacement of the pairs of bearing surfaces toward one another.

Assuming rolls R and R1 to be supported in a mill in readiness for removal therefrom, operation of the apparatus described above is as follows. Beam 12 is manipulated by an overhead crane to position roll end engaging assembly 10 in axial alignment with the rolls to receive roll ends N and N1. When assembly 10 is so positioned, or during maneuvering of beam 12 to so position the roll end engaging assembly, the beam is pivoted clockwise about axis 22 from the position shown in FIG. 1 to the position shown in FIG. 7. Pivotal movement of the beam in this manner is achieved by elevating the counterweighted end of the beam by means of an overhead crane and auxiliary beam support 20.

Figure 7:
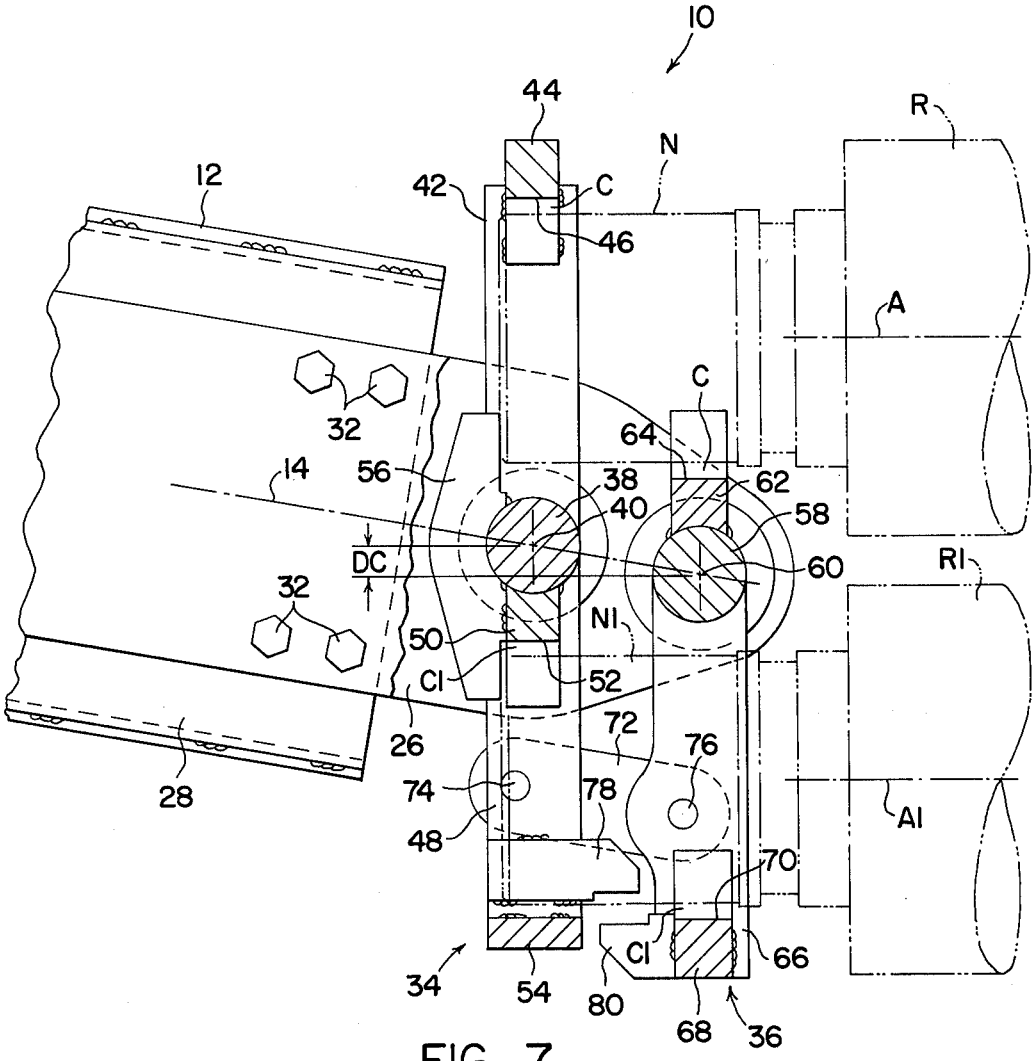

Such pivotal movement of beam 12 tilts axis 14 thereof and thus vertically displaces pin axes 40 and 60 relative to one another a distance DC, as seen in FIG. 7, which provides a total roll end diametrical clearance. In this respect, roll end engaging members 34 and 36 remain vertical and parallel to one another during such vertical displacement of pin axes 40 and 60, whereby opposed bearing surfaces 46 and 64 and opposed bearing surfaces 52 and 70 are vertically displaced away from one another a distance corresponding to the total clearance DC. As seen in FIG. 7, this provides clearance spaces C between bearing surfaces 46 and 64 and roll neck N and clearance spaces C1 between bearing surfaces 52 and 70 and roll neck N1. Each of the clearance spaces C and C1 is equal to half the total diametrical clearance DC, assuming the roll ends to be axially alined with the corresponding pair of bearing surfaces. It will be further appreciated that the total dimetrical clearance DC increases as beam 12 is tilted clockwise from the position shown in FIG. 7.

When beam 12 has been tilted as described above to provide a desired clearance dimension, the beam is moved axially toward the roll ends N and N1 for the roll ends to be received between the corresponding pairs of bearing surfaces, as shown in FIG. 7. The beam is then lowered through operation of the overhead crane to the horizontal position shown in FIG. 1, whereby pin axes 40 and 60 are vertically displaced relative to one another to move the pairs of bearing surfaces into engagement with the corresponding roll end. Engagement of the bearing surfaces with the roll ends would alone limit relative vertical displacement between members 34 and 36 in the direction causing displacement of the pairs of bearing surfaces toward one another. However, it is preferred to provide members 78 and 80 described hereinabove to positively limit such displacement and to assure that the rolls to be supported are not angled to an out-of-level condition during vertical lift of the rolls from the mill. It will be appreciated that when the components are in the position shown in FIG. 1, bearing surfaces 46 and 52 engage upper and axially outer portions of roll ends N and N1, and that bearing surfaces 64 and 70 engage lower and axially inner portions of the roll ends whereby, upon vertical lifting of the beam, the rolls are supported as cantilevers.

When the components are positioned as shown in FIG. 1, beam 12 is elevated by means of the overhead crane to vertically lift rolls R and R1 from the mill to facilitate the transport of the rolls away from the mill. To release the interengagement between roll end engaging assembly 10 and a pair of rolls, for example when the latter have been positioned in the mill, beam 12 is tilted upwardly from the position shown in FIG. 1 to the position shown in FIG. 7. This of course provides clearance between the pairs of bearing surfaces and the corresponding roll ends, as described hereinabove. This clearance then permits axial separation of the roll end engaging assembly from the roll ends.

It is to be noted at this point that the two point support of beam 12 by main and auxiliary support components, both located outside the centers of gravity of the beam in both the loaded and unloaded conditions thereof, provides positive control for manipulation of the beam at all times and eliminates the necessity for slings, sling shifting and auxiliary supports heretofore employed in connection with balance bar type roll changing equipment.

While considerable emphasis has been placed herein on a specific structure of the roll end engaging assembly and association of the latter with a balance bar beam, it will be appreciated that many changes can be made in the roll end engaging assembly without departing from the principles of the present invention and that the assembly can be employed with roll removing equipment other than that of the balance bar type. For example, a support for the roll end engaging members similar to support arms 26 could be mounted on the front end of a carriage type support vehicle to provide for the tilting of pin axes 40 and 60 in the manner and for the purpose described herein. Further, it will be appreciated that the roll end engaging assembly could be comprised of just one pair of cooperable roll end engaging bearing surfaces, and that the structures of the pivotal members which are provided with these surfaces could be other than the structures herein shown and described. Still further, it is important that the cooperable bearing surfaces be diametrically opposed and axially spaced apart with regard to the roll end, but the bearing surfaces themselves can have contours other than the preferred arcuate contours shown. For example, the bearing surfaces could be V-shaped when viewed axially, whereby each would engage the corresponding portion of a roll end on circumferentially opposite sides of a vertical plane through the roll end axis. These and other modifications of the preferred embodiment disclosed herein, as well as other embodiments of the invention, will be obvious and, accordingly, it is to be distinctly understood that the foregoing descriptive matter is to be interpreted merely as illustrated of the present invention and not as a limitation.

I claim:

1. Roll changing apparatus for a horizontal roll member including a roll end having a horizontal axis comprising, a first roll end engaging member including means defining a first bearing surface, a second roll end engaging member including means defining a second bearing surface, said first and second bearing surfaces receiving said roll end therebetween and engaging vertically aligned diametrically opposed axially spaced apart upper and lower portions of said roll end to support said roll horizontally as a cantilever, and support means supporting said first and second members for vertical displacement of said first and second members relative to one another transverse to said axis to displace said first and second bearing surfaces toward and away from one another.

2. Roll changing apparatus according to claim 1, wherein said first and second members are mounted on said support means for pivotal movement about parallel spaced apart horizontal pivot axes transverse to said roll end axis.

3. Roll changing apparatus for a roll member including a roll end having an axis comprising, a first roll end engaging member including means defining a first bearing surface, a second roll end engaging member including means defining a second bearing surface, said first and second bearing surfaces receiving said roll end therebetween and engaging vertically aligned diametrically opposed axially spaced apart upper and lower portions of said roll end to support said roll as a cantilever, support means supporting said first and second members for vertical displacement of said first and second members relative to one another to displace said first and second bearing surfaces toward and away from one another, said first and second members being vertically parallel, and means to maintain said first and second members parallel during said relative vertical displacement therebetween.

4. Roll changing apparatus for a roll member including a roll end having an axis comprising, a first roll end engaging member including means defining a first bearing surface, a second roll end engaging member including means defining a second bearing surface, said first and second bearing surfaces receiving said roll end therebetween and engaging vertically aligned diametrically opposed axially spaced apart upper and lower portions of said roll end to support said roll as a cantilever, support means supporting said first and second members for vertical displacement of said first and second members relative to one another to displace said first and second bearing surfaces toward and away from one another, and means on said first and second members interengaging to limit said relative vertical displacement in the direction displacing said first and second bearing surfaces toward one another.

5. Roll changing apparatus for a roll member including a roll end having an axis comprising, a first roll end engaging member including means defining a first bearing surface, a second roll end engaging member including means defining a second bearing surface, said first and second bearing surfaces receiving said roll end therebetween and engaging vertically aligned diametrically opposed axially spaced apart upper and lower portions of said roll end to support said roll as a cantilever, support means supporting said first and second members for vertical displacement of said first and second members relative to one another to displace said first and second bearing surfaces toward and away from one another, said first and second members being mounted on said support means for pivotal movement about corresponding horizontal pivot axes parallel to one another and transverse to said roll end axis, said first and second bearing surfaces being below the corresponding pivot axis, said first member including means defining a third bearing surface and said second member including means defining a fourth bearing surface, and said third and fourth bearing surfaces being above the corresponding pivot axis and receiving the roll end of a second roll therebetween and engaging vertically aligned diametrically opposed axially spaced apart upper and lower portions of said roll end of said second roll to support said second roll as a cantilever.

6. Roll changing apparatus according to claim 1, wherein said support means includes beam means having an axis and opposite ends, said first and second members being mounted on one of said ends for pivotal movement relative to said beam means about corresponding horizontal pivot axes parallel to one another and spaced apart axially with respect to said beam axis.

7. Roll changing apparatus for a roll member including a roll end having an axis comprising, a first roll end engaging member including means defining a first bearing surface, a second roll end engaging member including means defining a second bearing surface, said first and second bearing surfaces receiving said roll end therebetween and engaging vertically aligned diametrically opposed axially spaced apart upper and lower portions of said roll end to support said roll as a cantilever, support means supporting said first and second members for vertical displacement of said first and second members relative to one another to displace said first and second bearing surfaces toward and away from one another, said support means including beam means having an axis and opposite ends, said first and second members being mounted on one of said ends for pivotal movement relative to said beam means about corresponding horizontal pivot axes parallel to one another and spaced apart axially with respect to said beam axis, said first and second members being parallel, and link means pivotally interconnecting said first and second members to maintain said first and second members parallel during pivotal movement thereof relative to said beam means.

8. Roll changing apparatus according to claim 7, and means on said first and second members interengaging to limit movement of said first and second bearing surfaces toward one another.

9. Roll changing apparatus according to claim 8, wherein said first and second members have corresponding centers of gravity, said pivot axes being above the corresponding center of gravity, and said first and second bearing surfaces being below the corresponding pivot axis.

10. Roll changing apparatus for a horizontal roll member including a roll end having an outer end and a horizontal axis comprising, support member means, a first vertical roll end engaging member mounted on said support member means for pivotal movement about a first horizontal pivot axis extending transverse to said roll end axis, a second vertical roll end engaging member mounted on said support member means for pivotal movement about a second horizontal pivot axis parallel to said first pivot axis and laterally spaced therefrom, said first member including first bearing surface means to engage an upper portion of said roll end adjacent said outer end thereof and transverse to said roll end axis, said second member including bearing surface means to engage a lower portion of said roll end transverse to said roll end axis, said lower portion being spaced axially inwardly of said outer end from said upper portion, said first and second bearing surface means axially receiving said roll end therebetween in the direction from said second member toward said first member, and means to displace said support member means to pivot said first and second members relative thereto in corresponding opposite directions about said pivot axes, pivotal movement in one of said directions displacing said first and second bearing surface means vertically away from one another to freely receive said roll end therebetween and pivotal movement in the other of said opposite directions displacing said bearing surface means vertically toward one another to engage said roll neck therebetween.

11. Roll changing apparatus according to claim 10, wherein said first member includes means to engage said outer end of said roll end to axially position said first and second bearing surface means with respect to said roll end.

12. Roll changing apparatus for a roll member including a roll end having an outer end and an axis comprising, support member means, a first vertical roll end engaging member mounted on said support member means for pivotal movement about a first horizontal pivot axis extending transverse to said roll end axis, a second vertical roll end engaging member mounted on said support member means for pivotal movement about a second horizontal pivot axis parallel to said first pivot axis and laterally spaced therefrom, said first member including first bearing surface means to engage an upper portion of said roll end adjacent said outer end thereof, said second member including bearing surface means to engage a lower portion of said roll end spaced axially inwardly of said outer end from said upper portion, said first and second bearing surface means axially receiving said roll end therebetween in the direction from said second member toward said first member, means to displace said support member means to pivot said first and second members relative thereto in corresponding opposite directions about said pivot axes, pivotal movement in one of said directions displacing said first and second bearing surface means vertically away from one another to freely receive said roll end therebetween and pivotal movement in the other of said opposite directions displacing said bearing surface means vertically toward one another to engage said roll neck therebetween, said first and second members being vertically parallel, and link means pivotally interconnecting said members to maintain said members parallel during pivotal movement thereof relative to said support member means.

13. Roll changing apparatus for a roll member including a roll end having an outer end and an axis comprising, support member means, a first vertical roll end engaging member mounted on said support member means for pivotal movement about a first horizontal pivot axis extending transverse to said roll end axis, a second vertical roll end engaging member mounted on said support member means for pivotal movement about a second horizontal pivot axis parallel to said first pivot axis and laterally spaced therefrom, said first member including first bearing surface means to engage an upper portion of said roll end adjacent said outer end thereof, said second member including bearing surface means to engage a lower portion of said roll end spaced axially inwardly of said outer end from said upper portion, said first and second bearing surface means axially receiving said roll end therebetween in the direction from said second member toward said first member, means to displace said support member means to pivot said first and second members relative thereto in corresponding opposite directions about said pivot axes, pivotal movement in one of said directions displacing said first and second bearing surface means vertically away from one another to freely receive said roll end therebetween and pivotal movement in the other of said opposite directions displacing said bearing surface means vertically toward one another to engage said roll neck therebetween, and at least one stop projection extending from each of said first and second members toward the other, said projections having overlapping ends engaging during said pivotal movement of said members in said other direction to limit displacement of said first and second bearing surface means toward one another.

14. Roll changing apparatus for a roll member including a roll end having an outer end and an axis comprising, support member means, a first vertical roll end engaging member mounted on said support member means for pivotal movement about a first horizontal pivot axis extending transverse to said roll end axis, a second vertical roll end engaging member mounted on said support member means for pivotal movement about a second horizontal pivot axis parallel to said first pivot axis and laterally spaced therefrom, said first member including first bearing surface means to engage an upper portion of said roll end adjacent said outer end thereof, said second member including bearing surface means to engage a lower portion of said roll end spaced axially inwardly of said outer end from said upper portion, said first and second bearing surface means axially receiving said roll end therebetween in the direction from said second member toward said first member, means to displace said support member means to pivot said first and second members relative thereto in corresponding opposite directions about said pivot axes, pivotal movement in one of said directions displacing said first and second bearing surface means vertically away from one another to freely receive said roll end therebetween and pivotal movement in the other of said opposite directions displacing said bearing surface means vertically toward one another to engage said roll neck therebetween, said first and second roll end engaging members including portions extending above and below the corresponding pivot axis, said first and second bearing surface means being in the corresponding portion below said pivot axes, said first member including third bearing surface means in the portion thereof above said first pivot axis, the portion of said second member above said second pivot axis including fourth bearing surface means, and said third and fourth bearing surface means corresponding respectively to said first and second bearing surface means with respect to receiving and engaging the roll end of a second roll member.

15. Roll changing apparatus according to claim 10, wherein said support member means includes beam means having opposite ends, said first and second roll end engaging means being on one of said opposite ends, counterweight means on said beam means adjacent the other of said opposite ends, and means between said opposite ends to support said beam means in suspension and for horizontal tilting movement.

16. Roll changing apparatus for a roll member including a roll end having an outer end and an axis comprising, support member means, a first vertical roll end engaging member mounted on said support member means for pivotal movement about a first horizontal pivot axis extending transverse to said roll end axis, a second vertical roll end engaging member mounted on said support member means for pivotal movement about a second horizontal pivot axis parallel to said first pivot axis and laterally spaced therefrom, said first member including first bearing surface means to engage an upper portion of said roll end adjacent said outer end thereof, said second member including bearing surface means to engage a lower portion of said roll end spaced axially inwardly of said outer end from said upper portion, said first and second bearing surface means axially receiving said roll end therebetween in the direction from said second member toward said first member, means to displace said support member means to pivot said first and second members relative thereto in corresponding opposite directions about said pivot axes, pivotal movement in one of said directions displacing said first and second bearing surface means vertically away from one another to freely receive said roll end therebetween and pivotal movement in the other of said opposite directions displacing said bearing surface means vertically toward one another to engage said roll neck therebetween, said support member means including beam means having opposite ends, said first and second roll end engaging means being on one of said opposite ends, counterweight means on said beam means adjacent the other of said opposite ends, means between said opposite ends to support said beam means in suspension and for horizontal tilting movement, said first and second members being vertically parallel, and link means pivotally interconnecting said members to maintain said members parallel during pivotal movement thereof relative to said support member means.

17. Roll changing apparatus according to claim 16, and at least one stop projection extending from each of said first and second members toward the other, said projections having overlapping ends engaging during said pivotal movement of said members in said other direction to limit displacement of said first and second bearing surface means toward one another.

18. Roll changing apparatus according to claim 17, wherein said first and second roll end engaging members include portions extending above and below the corresponding pivot axis, said first and second bearing surface means being in the corresponding portion below said pivot axes, said first member including third bearing surface means in the portion thereof above said first pivot axis, the portion of said second member above said second pivot axis including fourth bearing surface means, said third and fourth bearing surface means corresponding respectively to said first and second bearing surface means with respect to receiving and engaging the roll end of a second roll member.

19. Roll changing apparatus according to claim 18, wherein the roll end of said second roll member has an outer end, said first roll end engaging member including means to engage said outer ends of said roll end of said roll member and second roll member to axially position said first and second bearing surface means and said third and fourth bearing surface means with respect to the corresponding roll end.

* * * * *